United States Patent [19]

Bulso, Jr. et al.

[11] 3,980,297

[45] Sept. 14, 1976

[54] METHOD AND APPARATUS FOR FEEDING SHEETS TO A TREATING MACHINE IN OVERLAPPED RELATION

[75] Inventors: Joseph D. Bulso, Jr.; William Russell Lewers, both of Canton, Ohio

[73] Assignee: Redicon Corporation, Canton, Ohio

[22] Filed: May 23, 1975

[21] Appl. No.: 580,181

[52] U.S. Cl. ..... 271/269; 271/14, 271/233; 271/DIG. 3

[51] Int. Cl.[2] ..... B65H 5/16

[58] Field of Search ..... 271/14, 10, 269, 267, 271/233, DIG. 3

[56] References Cited

UNITED STATES PATENTS

| | | | |
|---|---|---|---|
| 2,480,192 | 8/1949 | Laxd | 271/233 X |
| 3,034,783 | 5/1962 | Christa | 271/269 X |
| 3,073,593 | 1/1963 | Bauer | 271/269 X |
| 3,446,499 | 5/1969 | Ringler | 271/267 |

*Primary Examiner*—John J. Love
*Assistant Examiner*—Bruce H. Stoner, Jr.
*Attorney, Agent, or Firm*—Witherspoon and Lane

[57] ABSTRACT

Method and apparatus are disclosed for feeding a continuous series of sheets step-wise to a treating machine wherein the rearward and forward edges of successive sheets are overlapped to provide a continuous supply to the treating machine. Each sheet is fed in a simultaneous step-wise manner by a feed member engaging the rear edge of each sheet. The improvement comprises the delivering of each sheet onto the last sheet on the sheet feeder such that the forward edge of the delivered sheet overlaps the rear edge of the last sheet by an amount at least as great as the prescribed overlap so that the feed member adapted to engage the rear edge of the delivered sheet will in the next feed step engage the rear edge of the delivered sheet and bring it into proper overlap position with the adjacent forward sheet which has been moved its prescribed step at the same time. In one of the embodiments the feed step is slightly greater than that desired and means are provided to retract the sheet so that its rear edge abuts a stop to assure exact positioning of the sheet with respect to the treating machine.

6 Claims, 13 Drawing Figures

METHOD AND APPARATUS FOR FEEDING SHEETS TO A TREATING MACHINE IN OVERLAPPED RELATION

SUMMARY OF THE INVENTION

This invention relates broadly to sheet feeding and more specifically to method and apparatus for feeding sheets step-wise in overlapped relation to a treating machine to provide a continuous flow of sheets to said machine.

In the punch press field in order to obtain maximum production from the presses feeds have been devised whereby there is no gap hence every reciprocation of the press is a productive one. In the punching of circular members from sheets the art developed the scroll cut arrangement wherein the maximum number of cuts are obtained from the sheet. Thus, in order to obtain the desired continuous feed scroll cut sheets are fed in a series to the punch press with the trailing edge of each sheet being overlapped by the forward edge of the next adjacent following sheet. This overlap is kept to a minimum because it also represents waste. Great difficulty has been experienced in delivering sheets and positioning them on the sheet feeder in the prescribed overlapped relation. It is this problem to which the subject matter of this invention is directed.

In view of the above, it is an object of this invention to provide both method and apparatus for the feeding of sheets in step-wise manner to a treating machine and wherein the adjacent edges of successive sheets overlap a prescribed amount to provide a continuous flow of sheets to the treating machine.

It is another object of this invention to provide apparatus for the above wherein the apparatus includes a plurality of rows of feeding means wherein each row has a plurality of evenly spaced feed members adapted to engage the trailing edge of the sheet.

It is a further object to provide hold down means between rows of feed members so that the sheets will be held down to make certain that the feed members will engage the rearward edge of the sheet.

It is a still further object to provide hold down means between rows of feed members for holding down the sheets and wherein the hold down means reciprocates so as to bring the rear edge of the sheet into engagement with a positioning stop to assure exact positioning of the sheet with respect to the treating machine.

It is yet another object to provide a method whereby each sheet is delivered onto the last sheet on the sheet feeder such that the forward edge of the delivered sheet will overlap the rear edge of the last sheet by an amount at least as great as the prescribed overlap so that the feed member adapted to engage the rear edge of the delivered sheet will be in the next feed step engage the rear edge of the delivered sheet and bring it into proper overlap position with the adjacent forward sheet which has been moved its prescribed step at the same time.

It is another object to this invention to provide a sheet feed method as set forth above and wherein each sheet is fed stepwise toward the treating machine a distance greater than the requisite feed step, next each sheet is fed away from the treating machine until its rear edge engages a stop defining the exact position of the sheet with respect to the treating machine.

The above and other objects and advantages will become more apparent upon consideration of the following detailed description and drawings showing, by way of example, two embodiments of this invention.

IN THE DRAWINGS

FIG. 1 is an elevational view illustrating the entire operating combination wherein the sheet feeder of this invention would be used and includes sheet delivering apparatus which deposits the sheets on a sheet feeder which in turn feeds the sheets in stepwise manner to the punch press, FIG. 2 is a plan view of the sheet feeder showing the three rows of reciprocating feed fingers and interposed two rows of magnet hold downs, FIG. 3 is an end elevational view of the sheet feeder illustrating the cam and crank means for reciprocating the three rows of feed fingers, FIG. 4 is a plan view of two scroll cut sheets as they would be positioned on the sheet feeder clearly indicating the slight overlap between adjacent sheets and the position of the cutouts in the sheet, FIG. 5 shows the positioning of a following sheet on the sheet feeder as it is deposited thereon by the sheet delivering apparatus prior to the feed step, FIG. 6 illustrates the relative positions of the adjacent sheets during the feed step and wherein the delivered sheet has been brought into the prescribed position with the desired overlap, FIG. 7 is a plan view of a second embodiment of the sheet feeder showing the three rows of reciprocating feed fingers, interposed two rows of reciprocating magnet hold downs and the two rows of stationary sheet stops adapted to engage the rear edge of a sheet to properly orient each sheet with respect to the treatment machine, FIG. 8 is an end elevational view of the second embodiment illustrating the cam operated reciprocating rows of feed fingers and magnet hold down bars, FIG. 9 is an elevational view illustrating the second embodiment including the sheet delivery apparatus, the sheet feeder and press with details of the cam actuation of the magnet hold down bars, FIG. 10 is a plan view illustrating the second step in the delivery and feed of the sheets in the second embodiment, the first step of the delivery and feed being identical with that of the first embodiment as shown in FIG. 5, FIG. 11 is a plan view showing the third step in the delivery and feed of the sheets in the second embodiment wherein the sheets have been moved away from the treating machine so that the rear edge of each sheet will abut a stop and thus be accurately positioned with respect to the treating machine and ready for the prescribed machine action, FIG. 12 is a fragmentary view illustrating details of one of the stops and shows the ramp section over which a sheet slides in feed toward the treating machine, and FIG. 13 is a motion chart depicting the relative timing of the respective elements of the feeding arrangement of the second embodiment.

DETAILED DESCRIPTION OF THE INVENTION

Figure 1:
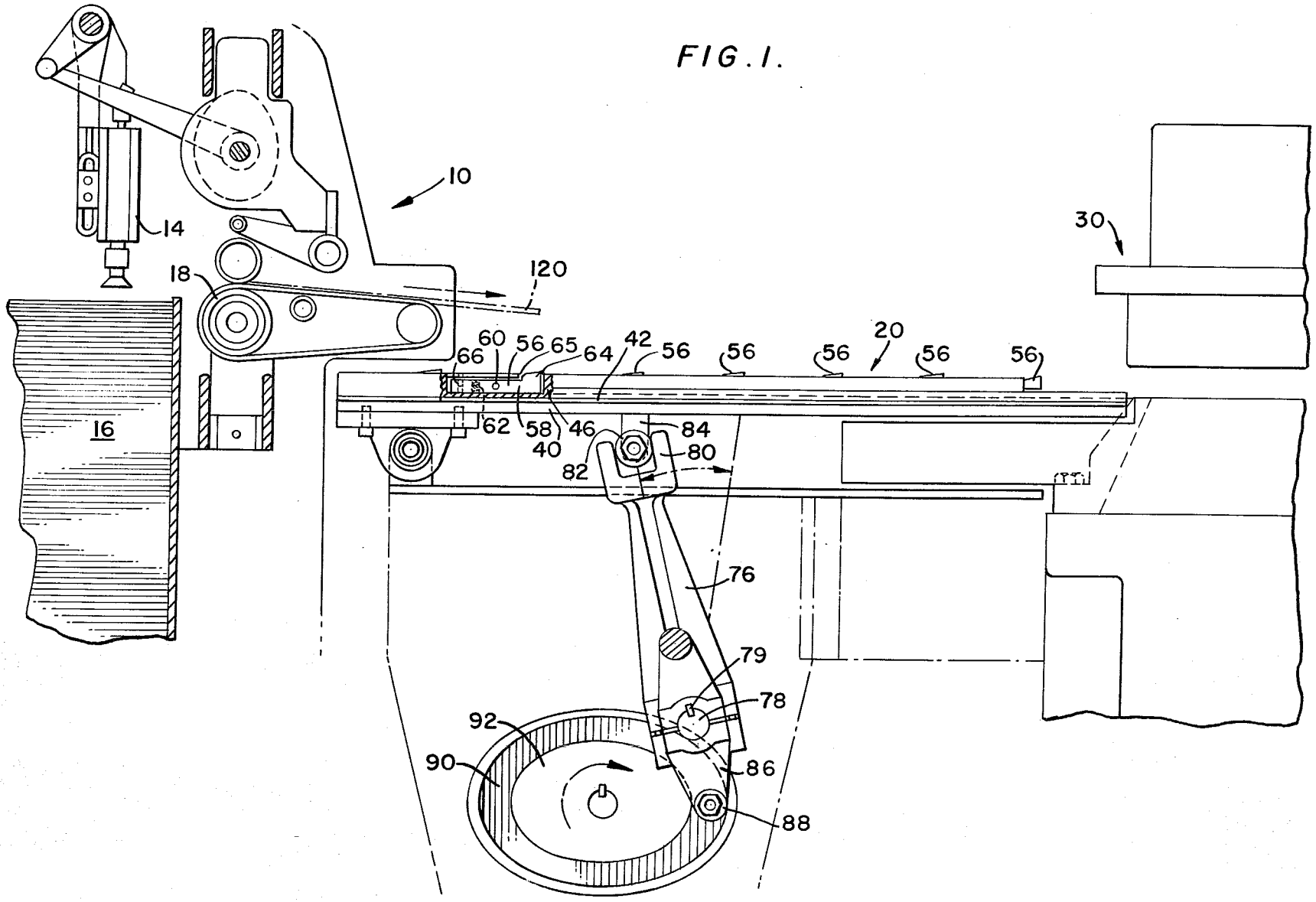

Referring to FIG. 1, there is shown in elevation the entire feed apparatus used in feeding sheets to a punch press in overlapped and continuous manner so that the press will not "cut air". The sheet delivering assembly 10 includes a suction cup assembly 14 which lifts up a single sheet from the sheet pile 16 and presents said sheet to belt conveyor 18. It should be noted that the sheet delivery assembly 10 must be properly oriented with respect to the sheet feeder 20 so that each sheet may be deposited on the sheet feeder in the prescribed manner to be described later. The sheet delivery assembly 10 may be of any desired design. In this connection reference may be had to U.S. Pat. Nos. 2,247,666, 2,556,895, 2,626,800 and 2,747,865 for details of sheet delivery assemblies which could perform the sheet delivery required in the instant invention. Sheet delivery units suitable for the present purpose are available on the commercial market.

Figure 2:
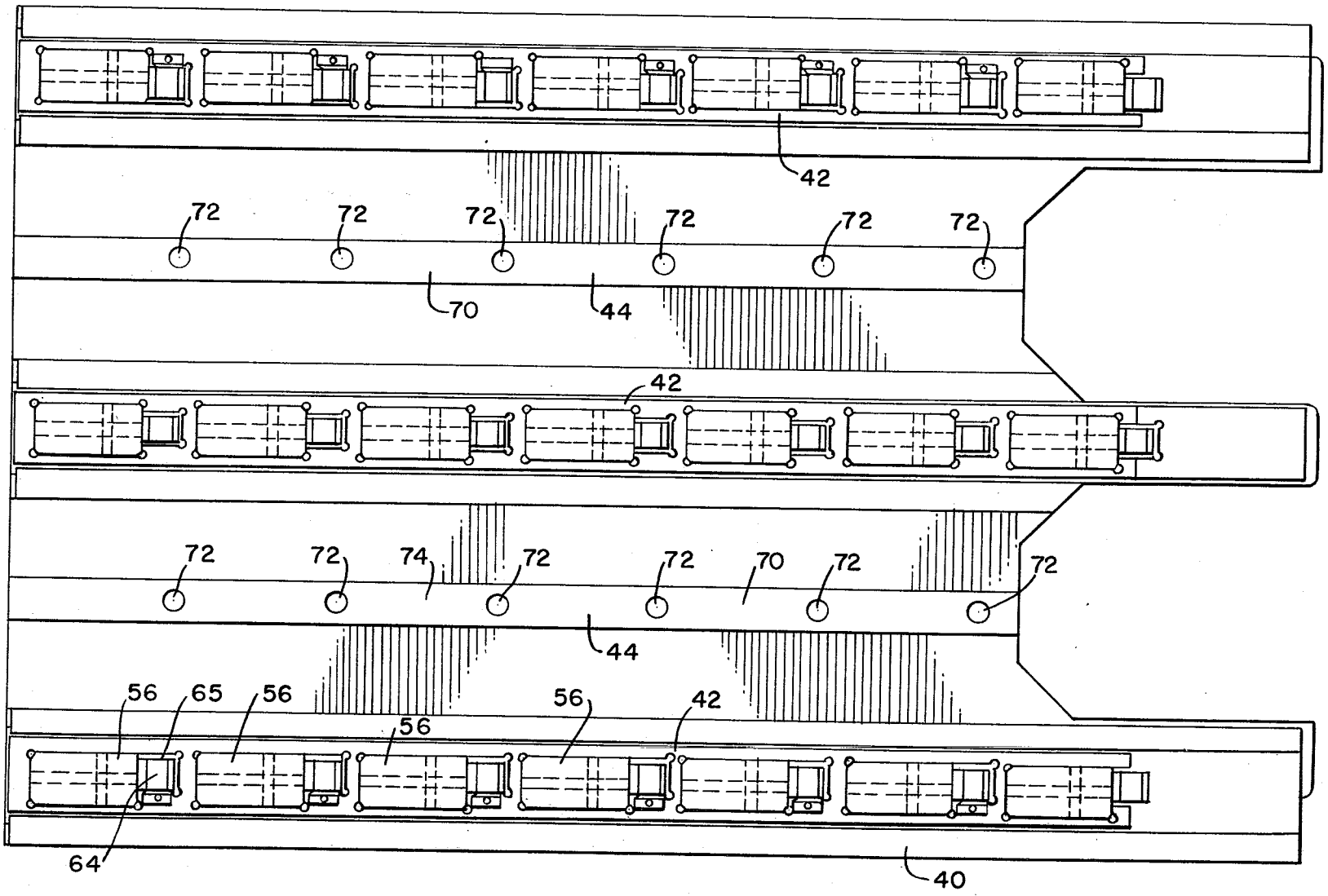
Figure 3:
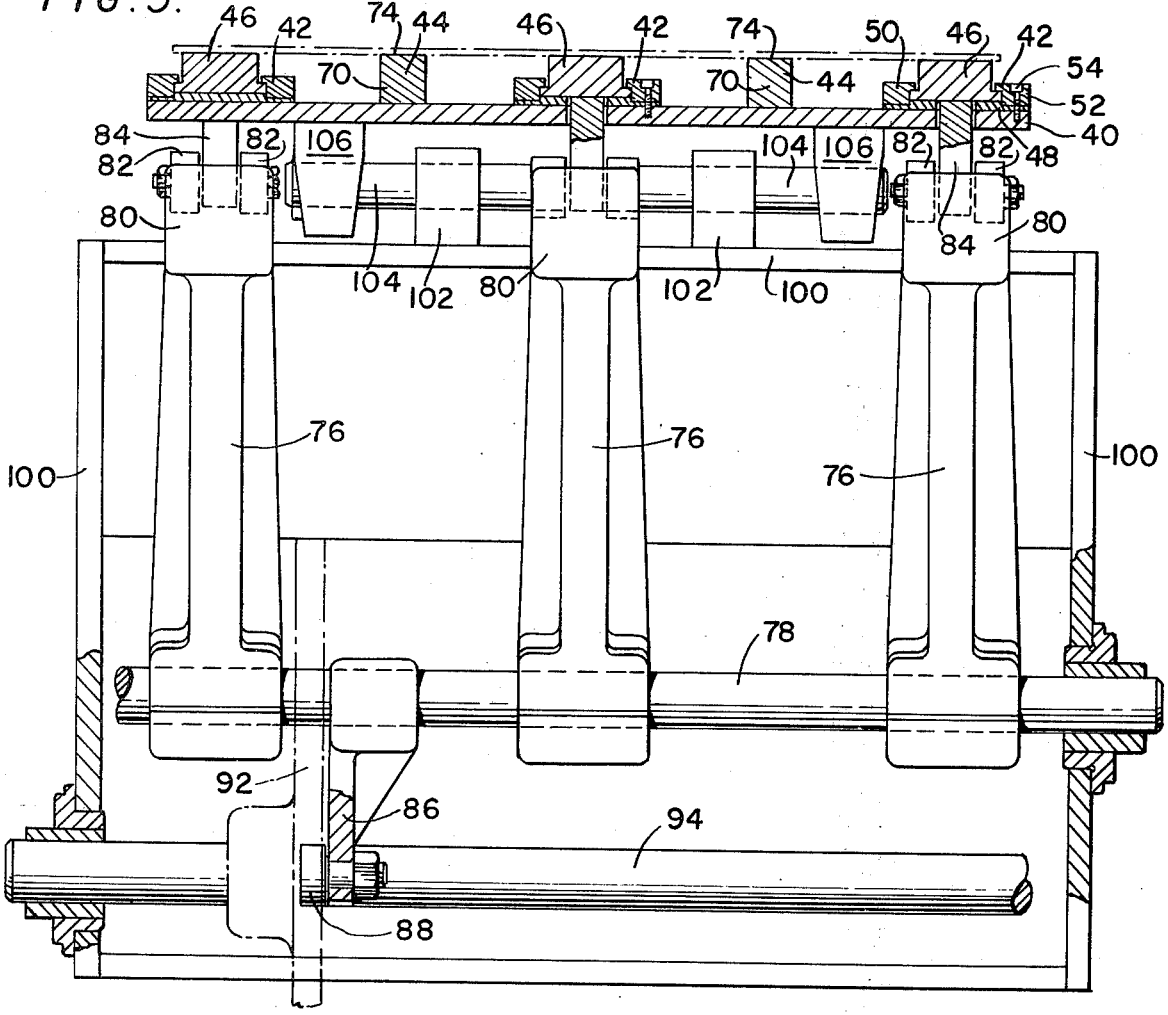

The sheet feeder 20 feeds the sheets in a continuous and overlapped manner to punch press 30. The sheets are fed in a step-wise manner wherein the distance of the feed step is dictated by the size of the item being cut by the press. Regarding details of the sheet feeder 20, attention is directed to FIGS. 1–3 of the drawings wherein the sheet feeder 20 comprises a base 40 on which are mounted three parallel feeder assemblies 42. In addition, two hold down assemblies 44 are carried on the base, one between each adjacent pair of feeder assemblies 42. More specifically, each feeder assembly 42 includes a longitudinally extending inverted T-shaped feeder bar 46 slidably carried by a base plate 48 and side track plates 50 and 52, said track plates being suitably secured to the base plate 48 by means of screws 54.

Each feeder bar 46 carries a plurality of evenly spaced feed finger assemblies 56, each assembly comprising a feed finger 58 pivotally supported by pin 60 and biased by spring 62 to cause the feed finger lug 64 to extend above the upper level of the feed bar 46. The feed finger assembly 56 is carried within a recess 65 in the feeder bar 46 and is adjustable by means of screw 66 to control the exposed height of the feed finger lug 64 above the upper level of the feeder bar. The strength of spring 62 is such that the lug 64 of the feed finger may readily be depressed by the weight of the sheet deposited in the sheet feeder.

Each hold down assembly 44 comprises a T-shaped bar 70 extending lengthwise between adjacent pairs of feeder bars 46. The T-shaped bar 70 is provided with a plurality of magnets 72 spaced along the bar such that the magnets 72 will be generally flush with the upper face 74 of the hold down bar 70.

The feeder assemblies 42 are reciprocated to provide the step-wise feed by means of a crank 76 pivotally carried by and affixed to shaft 78 by means of key 79. The outer end of the crank 76 is in the form of yoke 80 which engages rollers 82 supported by bracket 84 connected to feed bar 46. Shaft 78 is oscillated by means of cam lever 86 also secured to shaft 78 which lever has a roller 88 on its bottom end riding in groove 90 formed in cam 92. Power shaft 94 rotatably carries cam 92 to provide the rotation to produce the step-wise feed of the feeder assembly 42. It should be noted that this feed stroke is devised so that one step will equal the feed distance required to present sufficient new material to allow for a full cut. Obviously then, the feed stroke depends upon the size of the item being produced. This arrangement is not mandatory since a multiple step feed could be used if the situation so required.

Shafts 78 and 94 are supported by frame assembly 100 which frame also mounts the base 40 by means of frame bearings 102 supporting shaft 104. Base bearings 106 extend downwardly from the base 40 and are supported by shaft 104 which fits therein. Power from an outside source is furnished to power shaft 94 to effect rotation thereof.

Figure 4:
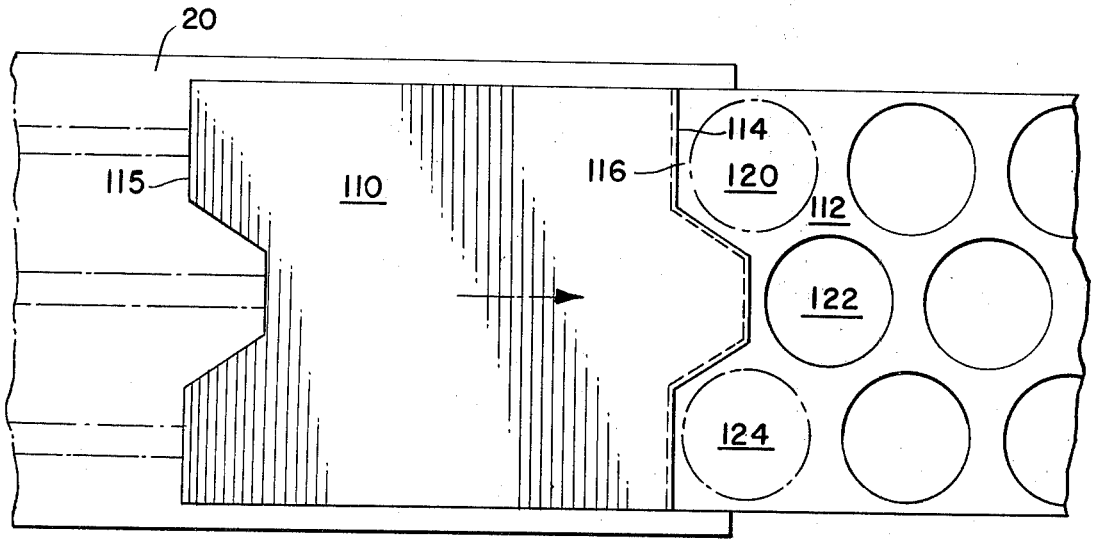

Referring to FIG. 4, the sheet feeder 20 has thereon two scroll cut sheets 110 and 112 as they are positioned immediately after the final punch has been made in the forward sheet 112. It should be noted that the forward edge 114 of the rearward sheet 110 overlaps the rear edge 116 of the forward sheet 112 by a small amount. This overlap is kept to an absolute minimum consistent with the tolerance required between punchings in the sheets. It is this small overlap which must be accurately maintained in order that the maximum utilization is realized from the sheets. With the sheets 110 and 112 in the position shown in FIG. 4, the next movement will be a forward feed equivalent to the distance required to provide sufficient material for punching a series of cut outs such as 120, 122 and 124 in sheet 112. As is the practice the cut outs are arranged to achieve maximum use of the scroll cut sheets.

In order to more clearly understand the environment in which this invention is practiced, it should be noted that the sheets are fed forward in stepwise manner by the engagement of the feed finger lugs 64 with the trailing edge of the sheets being so fed. The feed fingers are evenly spaced along the length of the feed bar 46. The spacing of the feed fingers bears a direct relation to sheet length. More specifically, a sheet should have a length equal to the distance between a given number of feed finger lugs 64 plus the amount of overlap desired.

Figure 5:
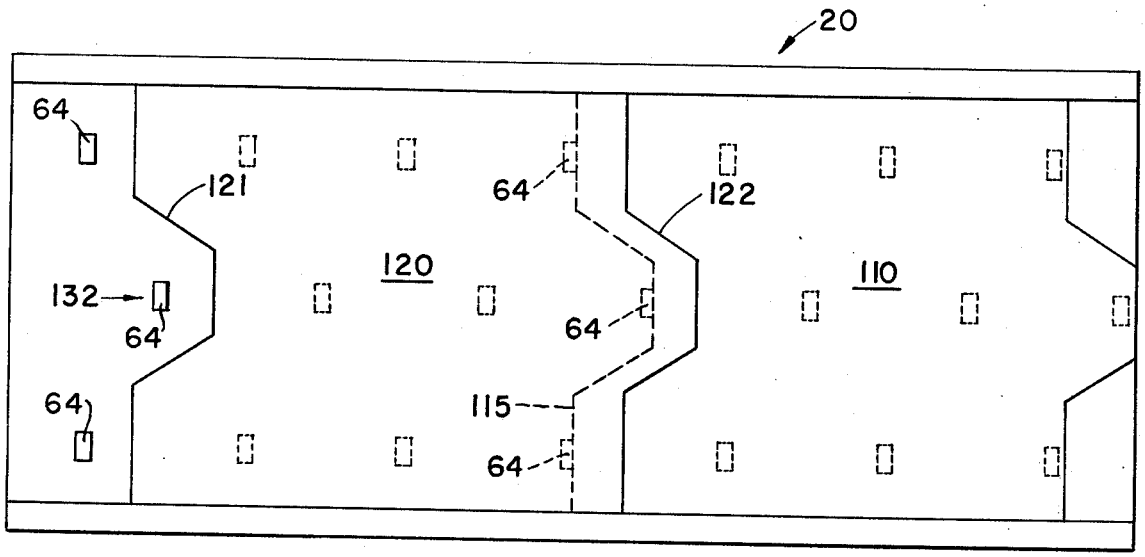
Figure 6:
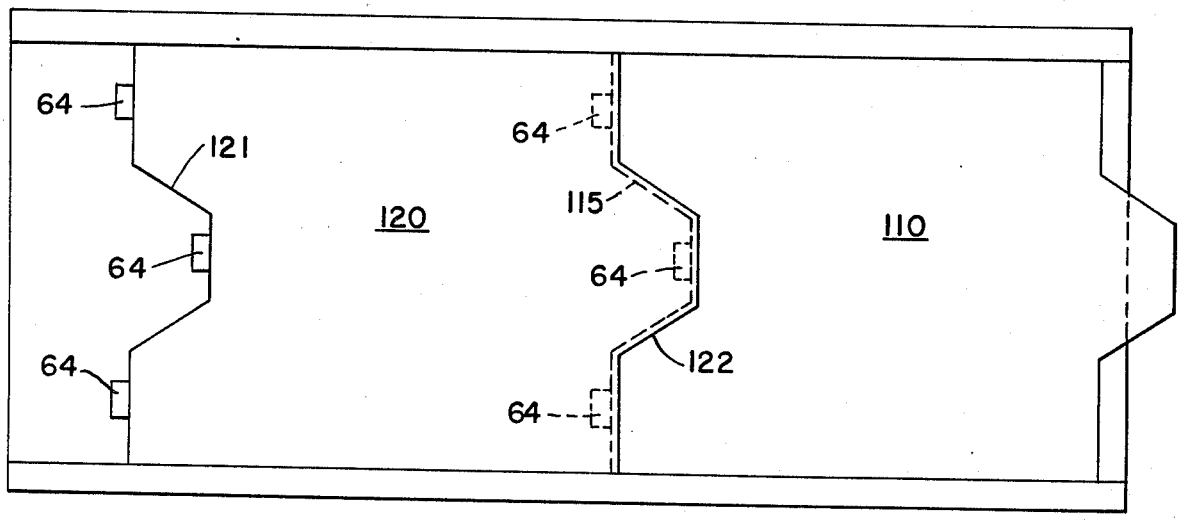

With the foregoing in mind and referring to FIGS. 1, 4, 5 and 6 the feed feature of this invention is as follows. In FIG. 4 the two sheets 110 and 112 are shown as they appear in normal feed condition with the prescribed overlap between the sheets. As shown, the feed stroke has been completed as well as the punch operation so that the punching of sheet 112 has been completed. At this stage another sheet should be fed into the sheet feeder 20. As illustrated in FIG. 1, a sheet 120 is being fed by belt feed 18 to the sheet feeder 20. As shown in FIG. 5, the sheet 120 has dropped down into the sheet feeder 20 with the forward edge 122 of sheet 120 overlapping the trailing edge 115 of sheet 110 by an amount greater than the overlap desired but less than one normal feed step. It should be noted that the sheets have a length equal to the space between the lugs of four consecutive feed fingers plus the requisite overlap. In addition, since the sheets are of the scroll cut type the forward and trailing edges of each sheet are offset, consequently, the positions of the feed fingers in the center row 132 are accordingly offset a like amount. Also the feed finger lugs 64 are in engagement with the trailing edge 115 of sheet 110. With the sheet feeder 20 in such position a feed step is commenced wherein all of the feed fingers move forward in unison. After a portion of the feed step has taken place the feed finger lugs 64 engage the trailing edge 121, meanwhile feed finger lugs 64 have been moving sheet 110 forward such that the relative positions of sheets 110 and 120 are as illustrated in FIG. 6 wherein sheet 120 now overlaps sheet 110 by the prescribed amount and the feed finger lugs are in engagement with the trailing edges of both sheets for completion of the feed stroke while maintaining the proper overlap.

The aforedescribed feed steps are continued for the entire run as desired. It will be apparent that the center row of feed finger lugs could be eliminated, even so, this additional assist in feeding has been found to be advantageous especially in feeding of thin gauge sheets.

In order to make certain that the sheets are held down smoothly on the sheet feeder 20 and to permit the return stroke of the reciprocating feed finger without changing the position of the sheets, two hold down bars 70 are provided, one between each adjacent row of feed fingers. As previously set forth, the feed fingers are spring biased to the up position so that the feed finger lugs 64 may engage the trailing edges of the sheets to be fed thereby. The magnets 72 in the hold down bar 70 are of sufficient strength that they will retain the sheets in position on the sheet feeder when the feed fingers are on the return travel. Further the magnets will hold the sheets in place whereby relative motion can take place between the sheets as occurs in the feed operation shown in FIGS. 5 and 6 wherein sheet 120 is deposited so that it overlies sheet 110 by an amount greater than the desired overlap whereby when the feed stroke commenced lugs 64 immediately push sheet 110 forward while sheet 120 remains stationary until engaged by lugs 64 as shown in FIG. 6.

This type of sheet feed makes it possible to have a very wide tolerance for the depositing of the delivered sheet 120 into the sheet feeder 20. About the only requirement is that the forward edge 122 of the delivered sheet 120 must overlap the trailing edge of the forward sheet 110 by an amount at least as great as the overlap requirement and no more than the distance between adjacent feed finger lugs 64 will present the uncut sheets to the exact press position required. Due to the close tolerances provided between cuts there is very little tolerance for inaccurate positioning.

The second embodiment of this invention is illustrated in FIGS. 7–13. The overall arrangement is quite similar to that of the first embodiment, in this invention reference is made to FIG. 9 wherein the overall general combination of the second embodiment is shown. The sheet delivering assembly 200 includes a suction cup assembly 202 which lifts up a single sheet from the sheet pile 204 and presents the sheet to belt conveyor 206. It should be noted that the sheet delivering assembly 200 must be properly oriented with respect to the sheet feeder 210 so that each sheet will be delivered onto the sheet feeder in the prescribed manner. The sheet delivering assembly 200 may be of any desired design as long as the necessary functions are provided. For further details of pertinent equipment along these lines reference is made to U.S. Pat. Nos. 2,247,466; 2,556,895; 2,626,800 and 2,747,865. Sheet delivery units suitable for the present invention are available on the commercial market.

The sheet feeder 210 feeds the sheets in a continuous and overlapped manner to punch press 220. Regarding details of the sheet feeder 210 reference is made to FIGS. 7–9 of the drawings wherein the sheet feeder 210 comprises a base 222 on which are mounted three parallel feeder assemblies 224. Two reciprocating hold down assemblies 226 are carried on the base 222, one between each adjacent pair of feeder assemblies 224. In addition, a pair of stop assemblies 228 are carried on the base adjacent the inbound side of each of the outside feeder assemblies 224. More specifically, each feeder assembly 224 includes a longitudinally extending inverted T-shaped feeder bar 230 slidably carried by a base plate 232 and side track plates 234 and 236, said track plates being secured to the base plate 232 by means of screws 238.

Each feeder bar 230 carries a plurality of evenly spaced feed finger assemblies 240, each assembly comprising a feed finger 242 pivotally supported by pin 244 and biased by spring 246 to cause the feed finger lug 248 to extend above the upper level of the feed bar 230. The feed finger assembly 240 is carried within a recess 250 in the feeder bar 230 and is adjustable by means of screw 252 to control the exposed height of the feed finger lug 248 above the upper level of the feeder bar 230. The strength of spring 246 is such that the lug 248 may be readily depressed by the weight of the sheet deposited on the sheet feeder.

Each hold down assembly 226 comprises a slidable hold down bar 260 having an inverted T-shape and carried on base plates 262 with side track plates 264 and 266 affixed thereto to engage and retain the hold-down bar 260 in place. A plurality of magnets 268 are mounted in the hold down bar 260 to act as the means for causing the transported sheet to be held by the hold down bar.

In the second embodiment the actuation of the feeder assemblies 224 is exactly like that described in the first embodiment, therefore a detailed description will not be repeated here. It is sufficient to note that cam 280 through lever 282 oscillates shaft 284. Cranks 286 connected to shaft 284 impart reciprocating motion to feeder bars 230.

The reciprocating action of the hold down bar 260 is also provided by a cam and lever system. Specifically, cam 300 is fixed on rotating power shaft 302. Cam follower 304 rides in cam groove 306 and oscillates crank 308 about shaft 284 on which it is rotatably carried, that is, crank 308 is free to rotate about shaft 284 on which it is mounted. The upper end of crank 308 is provided with a pair of rollers 310 fitting within bracket 312 connected to the hold down bar 260.

Figure 12:
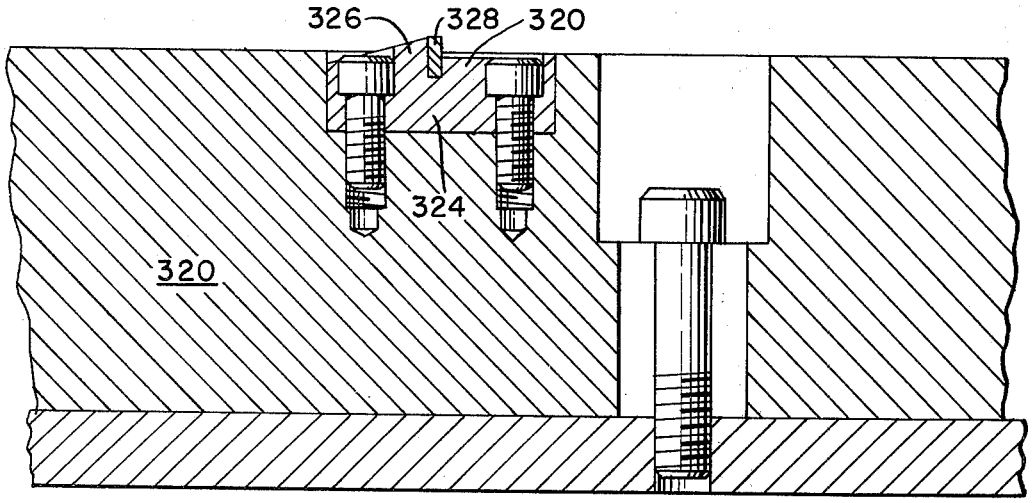

As previously stated, the second embodiment is provided with two stop assemblies, 228, one adjacent the inbound edge of the outer feeder assemblies 224. More specifically each stop assembly includes a feed linear base 320 mounted on track member 234 of the feeder assembly 224. A plurality of stops 322 are mounted on the top surface of the linear base 320, said stops being evenly spaced and so placed as to define exact positions of the sheets step-wise from the punch press 220. Details of the stop 322 are shown in FIG. 12, wherein the stop fits in a recess in the base 320 and comprises a body 324 having a ramp portion 326 tapering upwardly toward the punch press 220 and terminating in a stop element 328. Thus the stop element 328 is perpendicular to the base 320 and extends slightly above the upper surface thereof to be engaged by the trailing edge of a sheet. The ramp portion 326 makes it possible for the sheets to smoothly pass over the stop when travelling toward the punch press 220.

Figure 7:
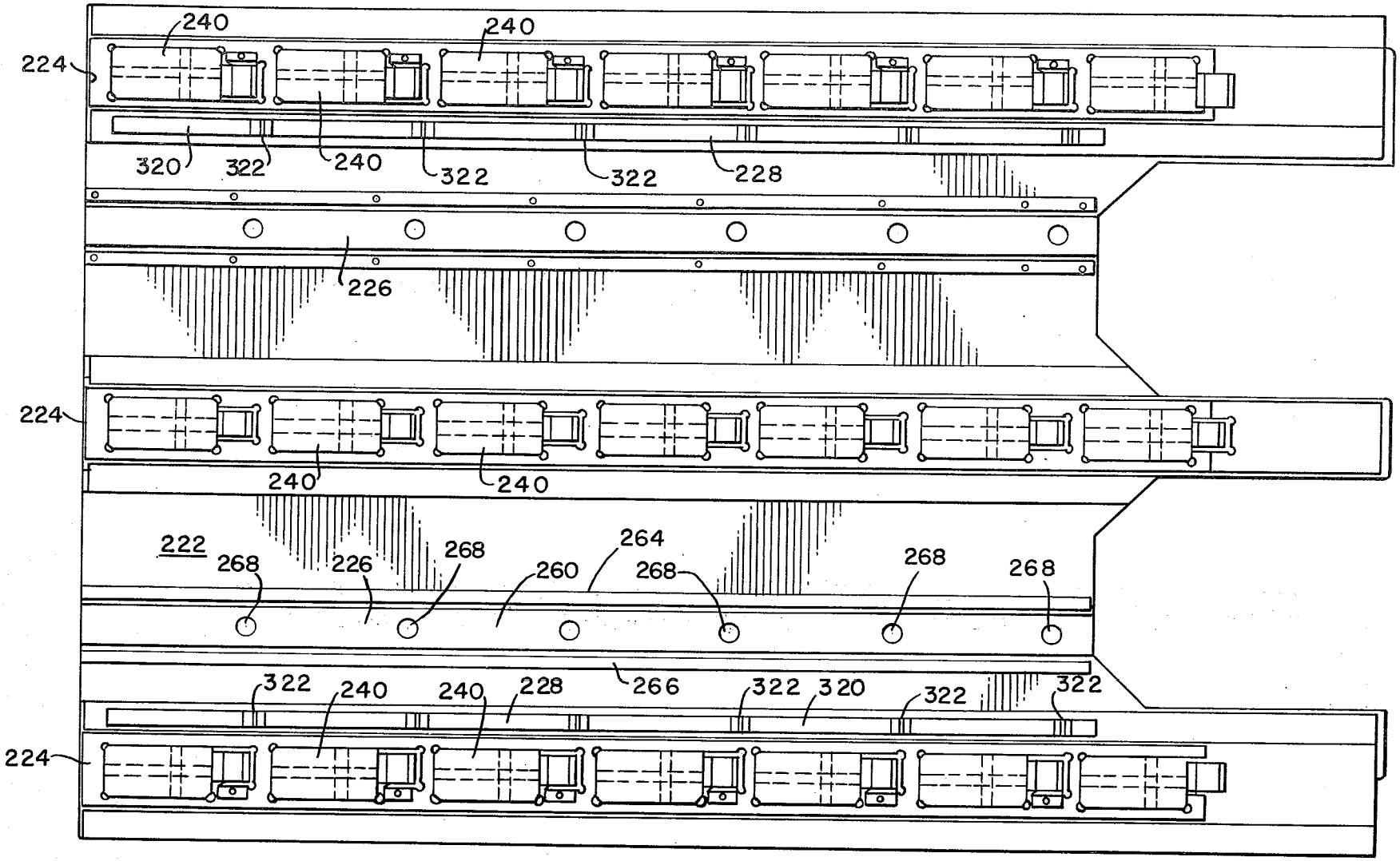
Figure 8:
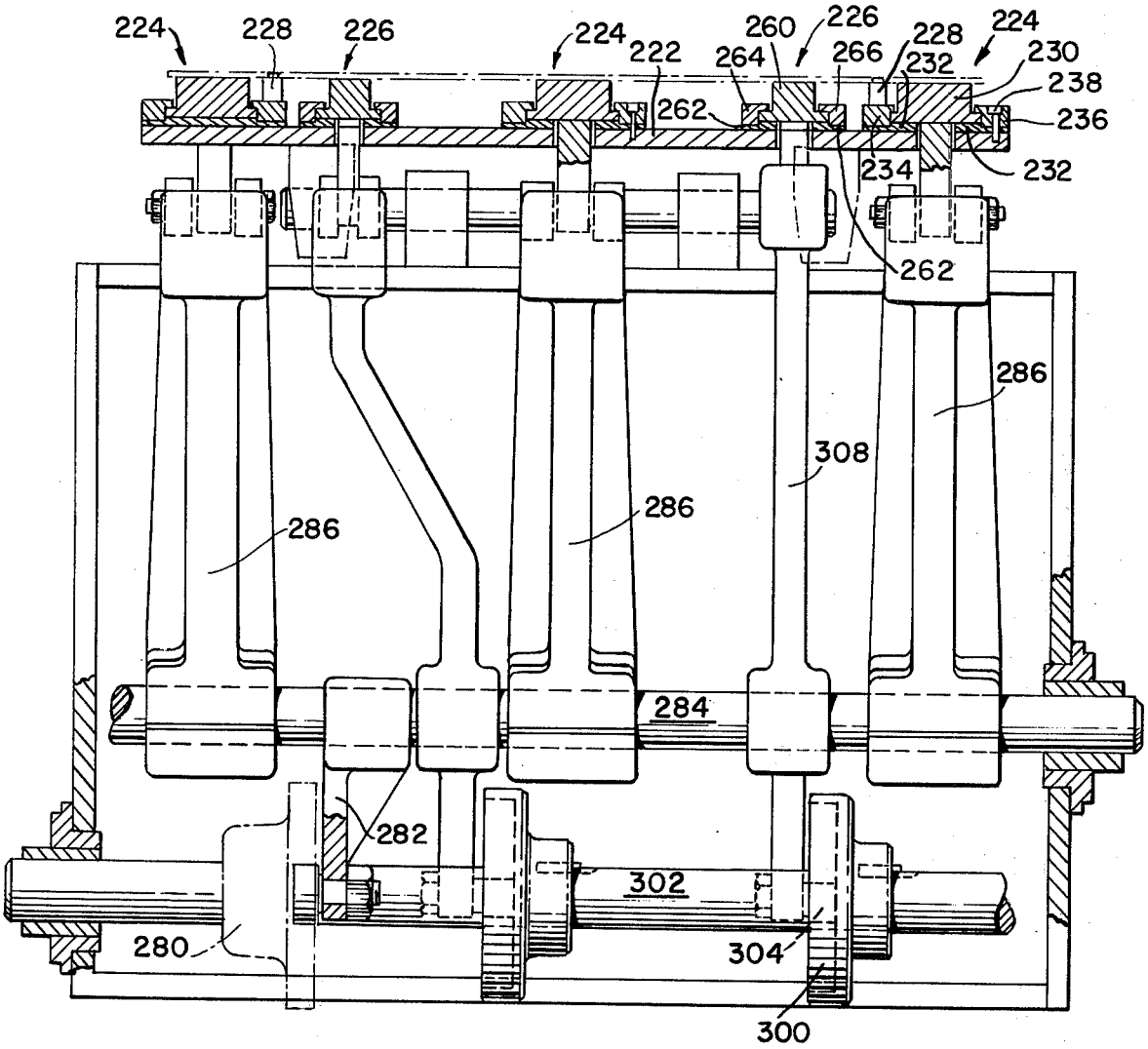
Figure 9:
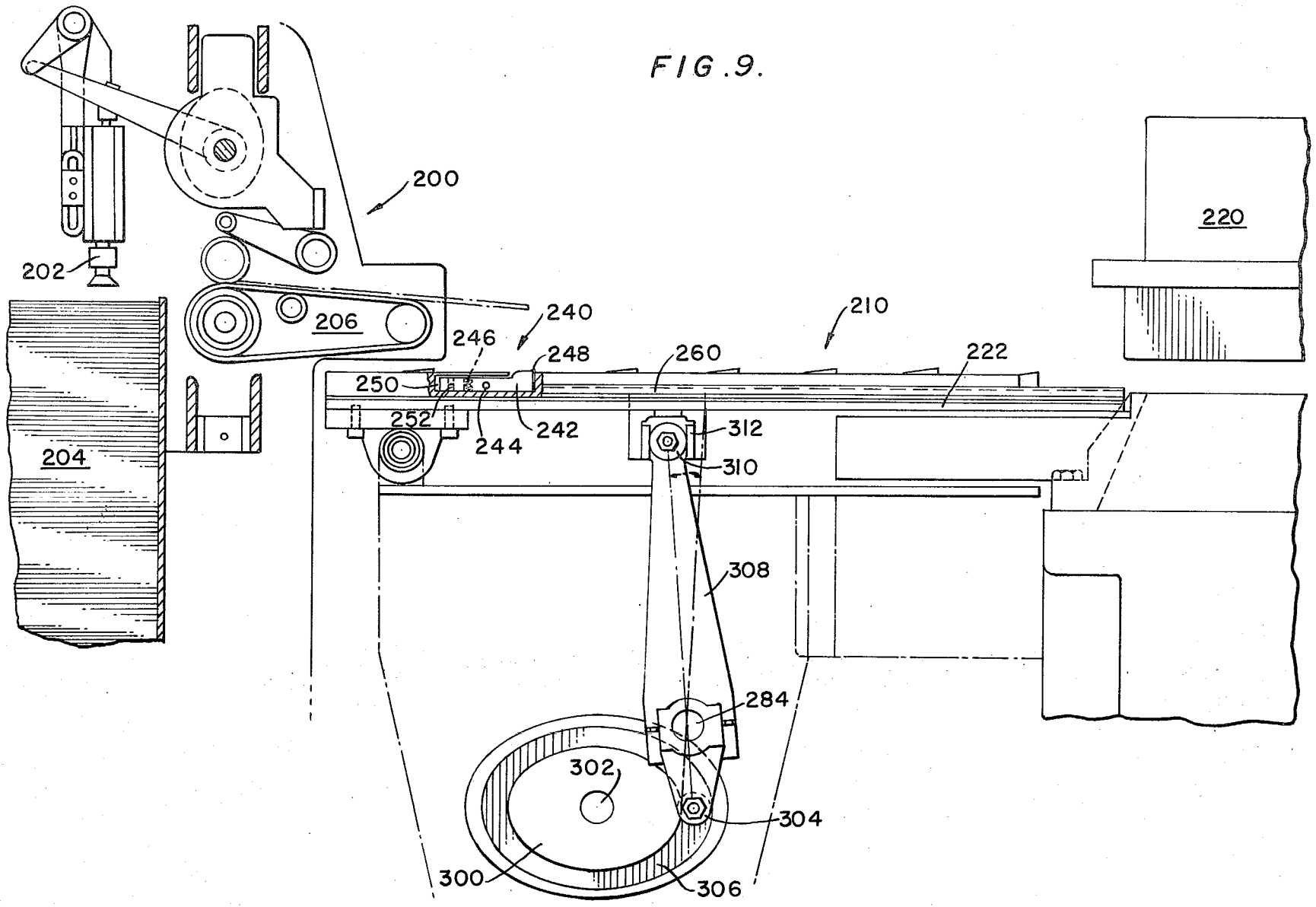
Figure 10:
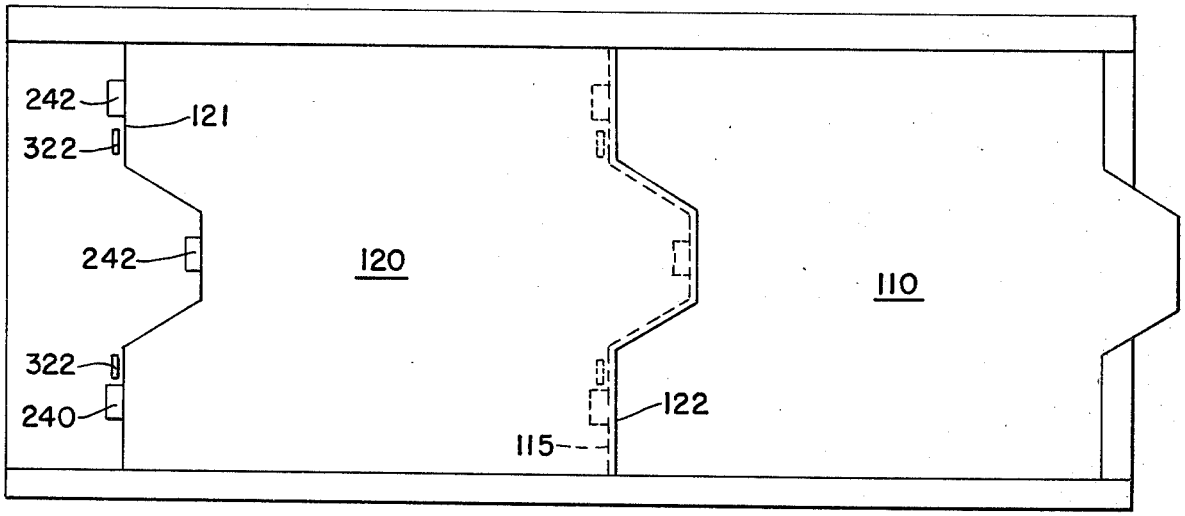
Figure 11:
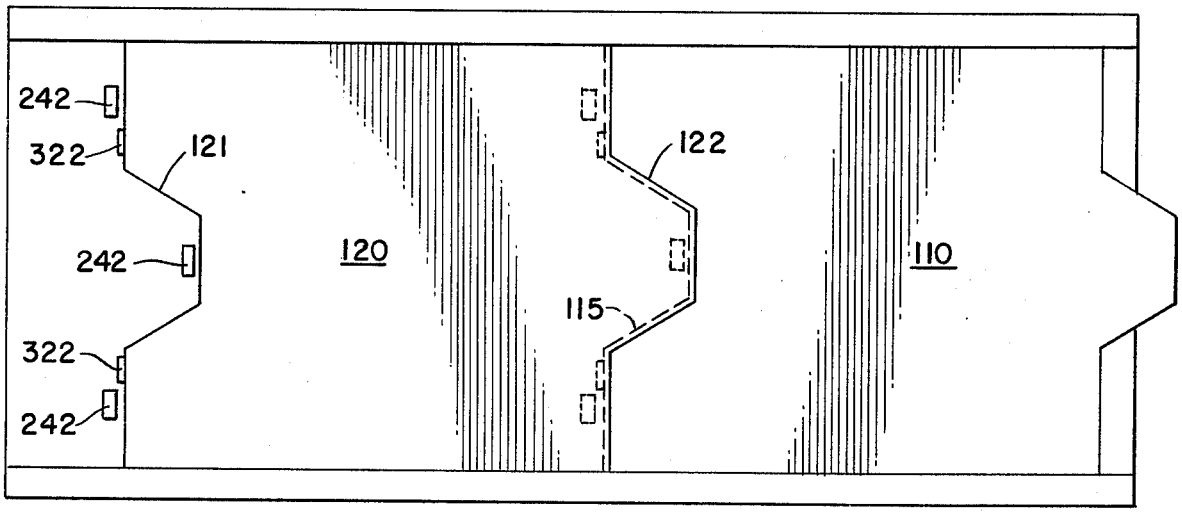

The operation of the second embodiment is generally similar to that of the first embodiment except for the part that the feed fingers push the sheet toward the punch press a slight amount more than the distance required to position the sheet for action by the punch press. This overfeed is useful in that it allows the hold down bar to carry the sheet rearward away from the press so that the trailing edge of the sheet will abut a stop and thus the sheet will be exactly positioned for action by the press. More particularly, the basic sheet feed is illustrated in FIGS. 5 10 and 11. As shown in FIG. 5, the sheet 120 is being fed by belt feed 18 to the sheet feeder 20 with the forward edge 122 of the sheet 120 overlapping the trailing edge 115 of the forward sheet 110 by an amount greater than the overlap desired but less than one normal feed step. It should be noted that the sheets have a length equal to the space between four consecutive stops 322 plus overlap. In the second embodiment, the trailing edge 115 of the forward sheet 110 when in position for action by the punch press will abut a stop 322 positioned just forward of each feed finger 242 as illustrated in FIG. 7 and FIGS. 10 and 11. Except for this action the second embodiment is the same as the first. With the sheets 110 and 120 positioned as in FIG. 5, a feed step is commenced whereby (Refer to FIG. 10) feed fingers 242 engage the trailing edge 115 of sheet 110 and move it pressward. Ultimately other feed fingers 242 will catch up to and abut the trailing edge 121 of sheet 120 and feed that sheet pressward so that upon the completion of the feed step the two sheets 110 and 120 will be properly oriented with respect to each other. In order to position sheets 110 and 120 for action by the punch press 220, the feed fingers are moved in a direction away from the press and the sheets are engaged by the hold down bar assemblies 228 which travel away from the press and cause the trailing edge of each sheet to abut a stop 322 whereby the sheets will be oriented for action by the punch press 220, as shown in FIG. 11.

It is interesting to note that the sheets are in engagement with the hold down bars 228 most of the time they are on the sheet feeder. The advantage derived from the magnetic gripping resides in the clutch effect wherein when the feed fingers take over the movement of the sheets the magnetic attraction is such that a slipping occurs yet when feed by movement of the hold down bars is desired there is sufficient gripping action for such. This makes overriding of feeds a simple matter which, of course, is desirable to insure proper feeding of the sheets.

Figure 13:
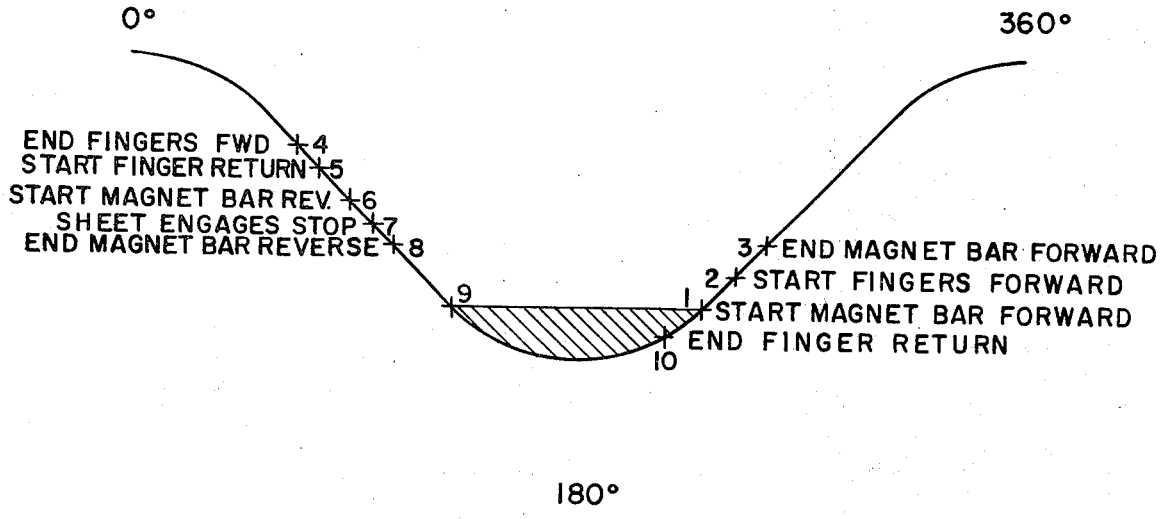

A complete cycle of the feed operation is shown in FIG. 13 wherein the shaded area represents that portion of the cycle wherein the sheet must be stationary in order that the punch press action may take place. Further, the timing of each step and feed disclosed herein is only illustrative since such may be varied as needs dictate. Starting at point 1 the hold down bar with its magnets gripping the sheet or sheets starts its movement toward the press for the next feed step since action by the press had just been completed. As previously stated and shown, the stops 322 are positioned slightly forward of the feed fingers 242 thus initial feed movement of the sheet is provided by the hold down bars. After a short traverse by the hold down bars, 228, point 2 of the cycle is reached and the feed fingers 242 start their forward movement toward the press but not yet engaging the sheet which is under influence of the hold down bars 228. Shortly thereafter point 3 is reached and the travel of the hold down bars stops and sheet feed is taken over by the continued travel of the feed fingers 242. Travel of the feed fingers continues until point 4 is reached at which point forward travel of the sheets stop as illustrated in FIG. 10. At point 5 the feed fingers 242 start their rearward travel away from the press and out of engagement with the sheets. While the feed fingers are travelling rearward, at point 6 the hold down bars 228 with the sheets gripped thereby start their travel away from the press. At point 7, the trailing edges of the sheets will engage stops 322 and thus be oriented for action by the punch press, see FIG. 11. At point 8, the rearward movement of the hold down bars 228 has been completed. Between points 9 and 1 the punch press action takes place while at point 10 the return of the feed fingers 242 has been completed.

The many variations that may be practiced within the scope of this invention are too numerous to be fully covered, for example the sheet size may be varied, the shape of the sheet may be changed depending on the configuration of the item being cut on the punch press, and the feed may be varied both with respect to timing and distance.

We claim:

1. Apparatus for feeding metal sheets stepwise to a treating machine in overlapped relation to provide a continuous flow of sheets to said machine, said apparatus comprising: a base adapted for positioning adjacent a treating machine, reciprocating sheet feed means on said base for feeding the sheets in step-wise manner to the treating machine, means for longitudinally feeding each sheet in the direction of feed of the reciprocating sheet feed means and for freely dropping each sheet on the base for engagement by the reciprocating sheet feed means whereby the rear edge of the forward sheet is overlapped by the forward edge of the sheet delivered to the feed means, said overlapping of the forward and delivered sheets being less than one step of the feed means, magnetic holddown means positioned in the sheet feed are to cause the metal sheets to rest smoothly on each other and further to assure positive engagement of the sheets by the reciprocating sheet feed means and wherein the sheets are lengthwise slightly longer than a given number of feed steps thus always providing an overlapping of adjacent edges of successive sheets.

2. A mechanism for feeding metal sheets step-wise to a treating machine in overlapped relation to provide a continuous flow of sheets to said machine, said mechanism comprising a base adapted for positioning adjacent a treating machine, a plurality of separate rows of feed fingers mounted on said base in longitudinally spaced relation for engaging the rear edge of the sheets on the base, means for reciprocating the feed fingers to feed the sheets in step-wise manner to the treating machine, means for longitudinally feeding each sheet in the direction of feed of the reciprocating sheet feed means and for freely dropping each sheet on the base for engagement by the reciprocating sheet feed means such that the rear edge of the forward sheet is overlapped by the forward edge of the sheet being delivered to the feed table, said overlapping of the forward and delivered sheets being less than one step of the feed of the means for reciprocating the feed fingers, magnetic holddown means positioned in the sheet feed area to cause the metal sheets to rest smoothly on each other and further to assure positive engagement of the sheets by the reciprocating sheet feed means, and wherein the sheets are slightly longer than a given number of feed steps thus always providing an overlapping of adjacent edges of successive sheets on the base.

3. A method of feeding a continuous series of metal sheets step-wise to a treating machine wherein the rearward and forward edges of successive sheets are overlapped to provide a continuous flow of sheets to said machine and wherein each sheet is fed in simultaneous step-wise manner by a feed member engaging the rear edge of each sheet, the improvement residing in the manner of delivering the sheets upon a base for engagement by a feed member to accomplish the desired degree of overlapping said improvement comprising the longitudinal feeding of each sheet in the direction of feed and the freely dropping of each sheet upon the base so that the forward edge of the delivered sheet overlaps the rear edge of the last sheet by an amount at least as great as the prescribed overlap so that the feed member adapted to engage the rear edge of the delivered sheet will in the next feed step upon forward movement engage the rear edge of the delivered sheet and bring it into proper overlap position with the adjacent forward sheet which has been moved its prescribed step at the same time and magnetically causing the sheets to rest smoothly on each other and to assure positive engagement by the feeding means.

4. The invention as set forth in claim 1 and wherein means are provided for moving each sheet away from the treating machine after the feed step by a distance less than said feed step and positioning said moved sheets such that they are in exact step-wise position for action by the treating machine.

5. The invention as set forth in claim 4 and wherein the means for moving each sheet away from the treating machine comprises a reciprocating bar having means therein for engaging each sheet for feed purposes and the positioning means comprises a plurality of stops placed at each step-wise position for exact positioning of each sheet with respect to the treating machine.

6. The invention as set forth in claim 1 and wherein the reciprocating feed bar is provided with magnets to hold the sheets on such feed bar.

* * * * *